US006387021B1

(12) United States Patent
Miller, Jr.

(10) Patent No.: US 6,387,021 B1
(45) Date of Patent: May 14, 2002

(54) INCREMENTAL WEIGHTS

(76) Inventor: George H. Miller, Jr., 2936 Miller Hts. Rd., Oakton, VA (US) 22124

( * ) Notice: Subject to any disclaimer, the term of this patent is extended or adjusted under 35 U.S.C. 154(b) by 42 days.

(21) Appl. No.: 09/605,000

(22) Filed: Jun. 28, 2000

(51) Int. Cl.[7] ..... A63B 21/06
(52) U.S. Cl. ..... 482/99; 482/98
(58) Field of Search ..... 482/93, 94, 97, 482/98, 106–108, 99; D21/675, 680, 681; 177/247, 248, 250, 252

(56) References Cited

U.S. PATENT DOCUMENTS

| | | | | | |
|---|---|---|---|---|---|
| 14,382 | A | * | 3/1856 | Yost | 177/167 |
| 115,268 | A | | 5/1871 | Baker et al. | |
| 141,556 | A | | 8/1873 | Harris | |
| 1,145,427 | A | | 7/1915 | Leuenberger et al. | |
| 3,567,221 | A | * | 3/1971 | Stults | 273/459 |
| 4,369,968 | A | * | 1/1983 | Price | 482/106 |
| 4,730,828 | A | * | 3/1988 | Lane | 482/94 |
| D306,332 | S | * | 2/1990 | Mayfield | D21/681 |
| 4,971,305 | A | * | 11/1990 | Rennex | 482/93 |
| D318,700 | S | * | 7/1991 | Davis | D21/681 |
| 5,421,797 | A | * | 6/1995 | Fletcher | 482/106 |
| 5,429,570 | A | * | 7/1995 | Beyer | 482/104 |
| 5,435,800 | A | * | 7/1995 | Nelson | 482/108 |
| 5,484,367 | A | * | 1/1996 | Martinez | 482/107 |
| 5,580,341 | A | * | 12/1996 | Simonson | 482/100 |
| D378,386 | S | * | 3/1997 | Brubaker | D21/681 |
| 5,643,152 | A | | 7/1997 | Simonson | |

* cited by examiner

*Primary Examiner*—Jerome W. Donnelly
*Assistant Examiner*—Victor Hwang
(74) *Attorney, Agent, or Firm*—George H. Miller, Jr.

(57) ABSTRACT

Small circular weights on substantially horizontal bars can be transferred to corresponding substantially horizontal bars for use in weighing scales, exercise equipment weight stacks or any other environment in which it is desirable to transfer incremental weights from a frame support to a loading condition on another frame. An improvement consists of having the upper edge of the vertically oriented circular weight contain an indicia on the top edge readable by the user and maintained in the same position preventing the indicia from rotating to the side or bottom and out of view.

6 Claims, 2 Drawing Sheets

INCREMENTAL WEIGHTS

BACKGROUND OF THE INVENTION

Incremental weighs have been used in various environments to provide balance and/or additional loads.

In the weighing scale art, circular weights have been added to a weighing beam to provide balance or to change a weighing range of the balance beam. In U.S. Pat. No. 115,268 to Baker et al, horizontally disposed incremental disc weights are transferred by finger operation of various levers to selectively add the increments to a balance beam. In U.S. Pat. No. 1,145,427 to Leuenberger vertically disposed incremental disc weights are also transferred by finger operation of various levers to selectively add the increments. U.S. Pat. No. 141,556 to Harris is a much simpler device in which vertically disposed incremental disc weights are transferred by finger manipulation from one horizontal bar on the scale frame to another coaxial bar. Opposite the frame is a parallel member comprising the pivoting weighing beam and having four corresponding bars in line respectively with each of the other four bars with a slight gap between the tips of the bars. The capacity of the scale is changed by transferring the desired incremental weight from the frame bar to the respective weighing beam bar. The disc weights remaining on the frame do not enter into the weighing operation. This simple horizontal transfer of incremental weights is the subject of this invention.

In another environment, progressive resistance exercises with weights have become popular for physical development and for specialized training in specific sports. The first recorded example in history of incremental weights in exercise is Milo of Crotona who carried a growing bull on his shoulders around an arena on a daily workout. The bull grew in weight while Milo grew in strength. At that time in history when livestock were not raised to be fattened with special feedings and steroids, it is estimated that a bull might reach a weight of four hundred pounds. Today's weight lifters can handle much more than four hundred pounds but the system of using increasing increments of weight is still a sound training principle.

In the latter part of the nineteenth century and early part of the twentieth century, barbells with hollow globular structures on each end became popular. Small balls of lead ammunition could be placed in the hollow globes and increments could be adding in very small increments.

Alan Calvert, a popular strongman who put on exhibitions and billed himself as "Milo the Great" replaced these small balls of lead with flat plates with slanted edges that could be placed within the hollow globes. He later eliminated the hollow globe and just used the plates. His company was the Milo Barbell Company and he sold it to Bob Hoffman of York, Pennsylvania who kept the basic plate design and renamed the company the York Barbell Company. His smallest barbell plates were 1¼ pound plates. The placing of circular plates with central holes on bars also required that a collar be placed on each end and tightened to prevent the plates from falling off if the user tilted the bar too much. This was considered an inconvenience and efforts were directed to make weight loading/changing more convenient.

Pulley machines were a step forward and weight stacks mounted on vertical guide bars were introduced in which a central bar with holes was inserted down thru central holes in the stack of weights. Each weight in the stack has a horizontal hole that mates with a hole in the central bar. By inserting a pin in the hole and thru the hole in the central bar, the desired weight can then be lifted by the pulley. Each weight in the stack is labeled with a number representing the position in the stack or the actual weight of the accumulated weight at that position of the pin. Smaller increments of weights that had a proper outline of cutouts compatible with the vertical guide bars and the central bar could be set on top of the topmost weight in the stack to add to the weight stack resistance.

U.S. Pat. No. 5,643,152 to Simonson provides an added feature that eliminates the inconvenience of having to pick up and place the smaller increment weight with cutouts on the topmost weight. FIG. 1, labelled "PRIOR ART", illustrates this feature as applied to a weight stack in an exercise machine. Small circular weights 1 with centrally located holes 2 are supported on an outer frame member 3 by a bracket 4 on a horizontal pin 5. Another pin 6 is secured to the topmost weight 7 and is horizontally lined up with the other pin 5 with a slight gap between them. Each pin has a bumper 9 defining a length that can support all the small circular weights. The stack 10 has holes 11 for each weight in the stack and the insertion of a pin will select that weight. The small circular weights are normally supported on the pin on the frame and they can be moved along the first pin on the frame to the second pin on the topmost weight to increase the stack weight by an amount smaller, perhaps ⅓ or ¼ the amount of the next plate down in the stack. In the example shown, the pin could be inserted at 195 pounds and each increment could be 3¾ pounds so that a user could increase incrementally from 195 to 198¾ to 202½ to 206¼ before using the next stack weight of 210. Each increment could be 5 pounds and the increments could go from 195 to 200 to 205 to 210.

SUMMARY OF THE INVENTION

The following is a proposed improvement in the use of small circular weights on substantially horizontal bars that can be transferred to corresponding substantially horizontal bars for use in weighing scales, exercise equipment weight stacks or any other environment in which it is necessary to transfer incremental weights from a frame support to a loading. condition on another frame.

It is an object of this invention to provide the incremental weights and bars in a kit form so that modifications can be made to weighing scales or exercise equipment stacks or other environments needing additional incremental loads or balances that would benefit from the addition of incremental weights.

It is an object of this invention to provide labels or indicia on the circular weights so that the user can observe the amount of weight added in the same manner that he or she can observe the amount of weight selected by the pin position in the stack on an exercise equipment frame. Labels on the existing plates in the prior art cited would not be properly oriented because the circular weights can rotate to any position on the respective horizontal pins and the label may be on the bottom out of sight. The small circular plates must be oriented so that the indicia on the top edge is fixed and can be seen by the machine user. This can be achieved by four methods.

DETAILED DESCRIPTION OF THE INVENTION

Figure 1:
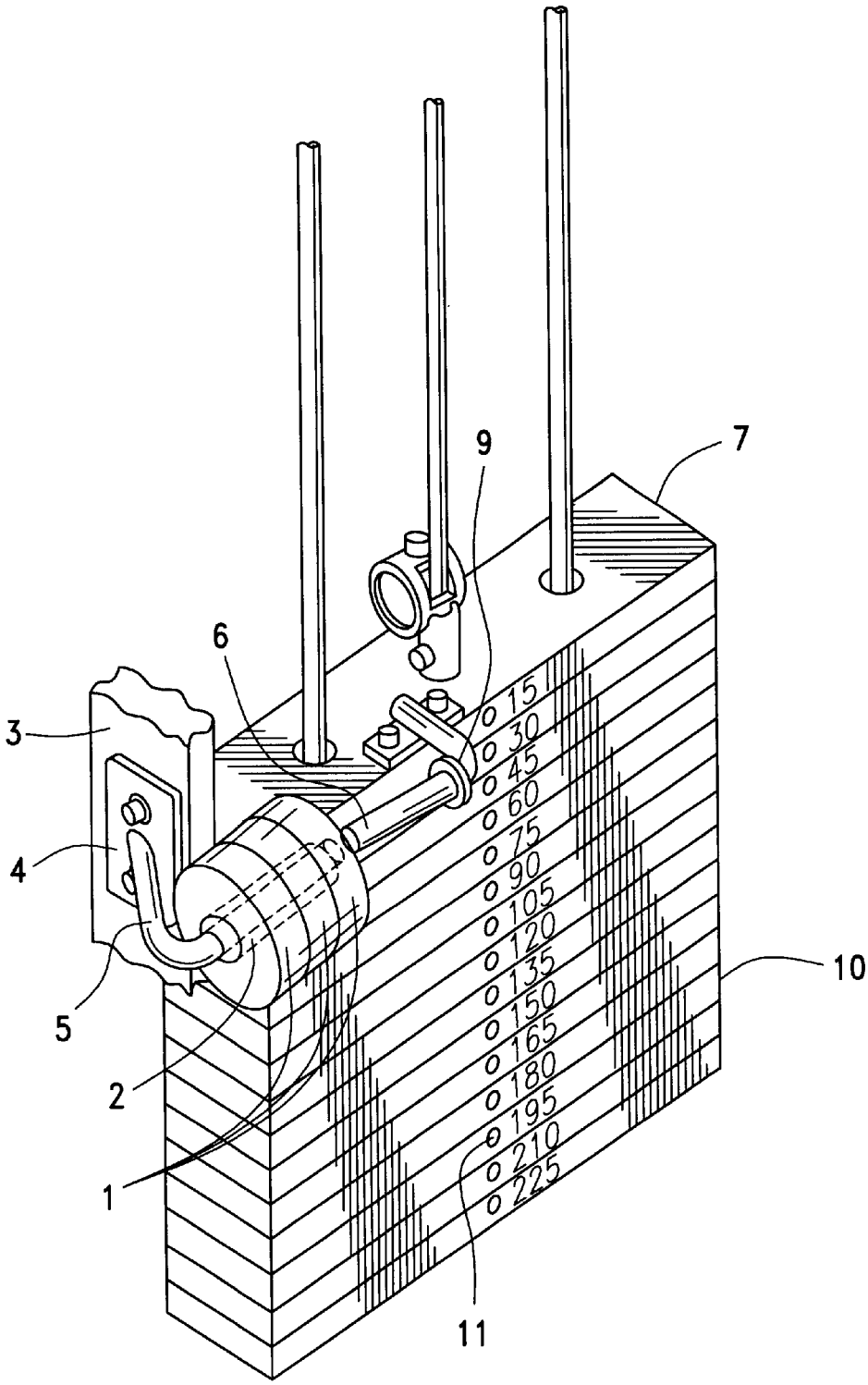
FIG. 1 PRIOR ART
FIG. 1, "PRIOR ART" shows a current embodiment in an exercise machine weight stack with rotatable small circular plates with a centrally located circular hole but without indicia.
Figure 2:
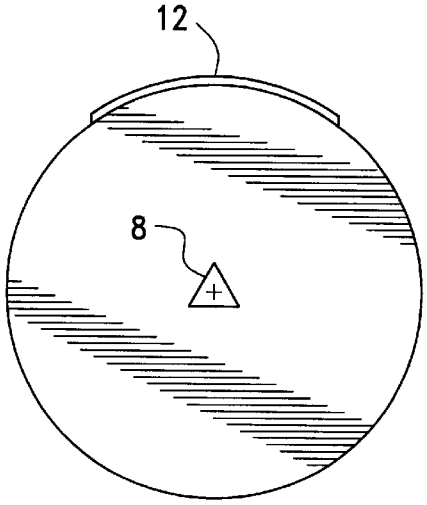
In FIG. 2, the circular hole in the circular plate is replaced by a triangular hole.

FIG. 2 has a centrally located triangular hole 8 with an applied label of indicia 12 stating the amount of weight of the disc.

Figure 3:
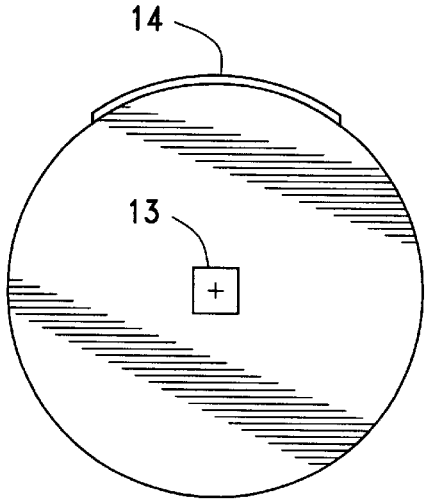
In FIG. 3, the circular hole in the circular plate is replaced by a rectangular hole.

FIG. 3 has a centrally located rectangular hole 13 with an applied label of indicia 14 stating the amount of weight of the disc.

Figure 4:
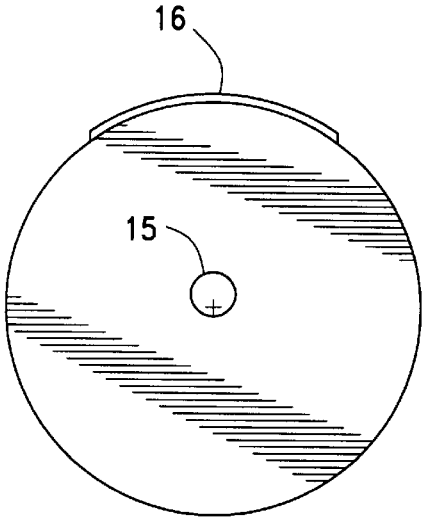
In FIG. 4, the circular hole in the circular plate is retained but placed off-center.

FIG. 4 has a slightly off-center circular hole 15 with an applied label of indicia 16 stating the amount of weight of the disc. The off-center hole causes the heavier portion of the disc to orient the indicia 16 at the top as in FIGS. 2 and 3.

Figure 5:
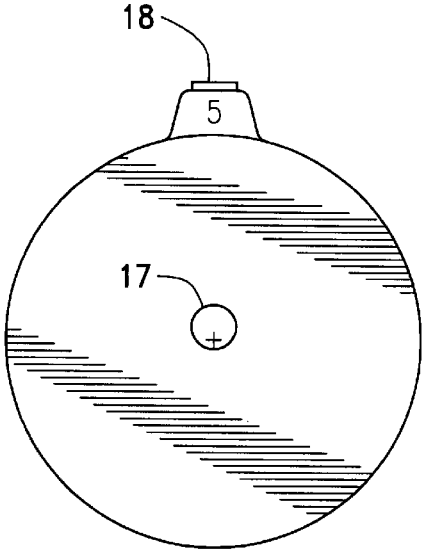
FIG. 5 is the same as FIG. 4 with an added indicia feature.

FIG. 5 is identical to FIG. 4 in hole location but a more permanent indicia is formed by a raised indicia 18, e.g. cast metal as part of a cast disc, that can be read from the side or from above. The weight of each disc can be stated in the indicia or the cumulative amount of the discs can be stated as in the cumulative stack indicia.

Since the environment in which the weight discs are transferred and used may involve some vibration, each bar should be tilted slightly upward, 3 to 5 degrees, so that any vibration will cause the discs to gravitate toward the respective bumper on each bar.

Figure 6:
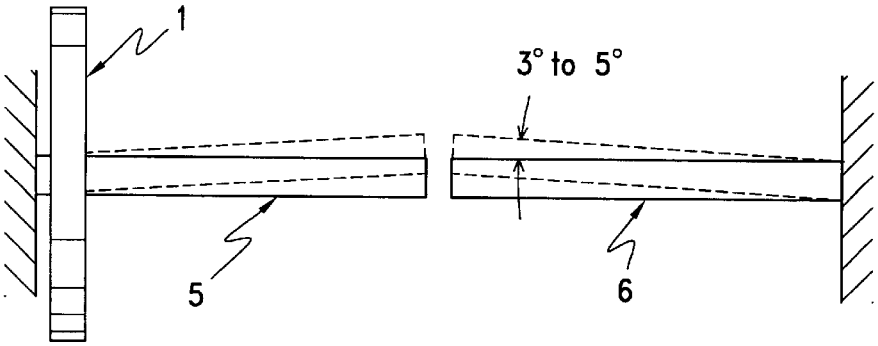
FIG. 6 shows a generic relationship of the circular plates and bars.

FIG. 6 shows the variance in the horizontal orientation of the bars from substantially horizontal to a slight tilt of 3 to 5 degrees.

Having described the preferred embodiment and obvious modifications of it, there may be others that are obvious and are intended to be covered by this disclosure.

What is claimed is:

1. A weight transfer device comprising:

a pair of bars, each bar having a distal end, a proximal end, and an axial length with a cross-sectional shape;

said bars being supported;at their distal ends so that their proximal ends are selectively positioned adjacent one another with a small gap between said proximal ends;

at least one vertically oriented incremental weight disc having parallel, planar faces, a peripheral edge perpendicular to said planar faces, and a hole having a shape to receive one of said bars along its axial length;

said at least one vertically oriented incremental weight disc having a raised portion with a top surface and side surfaces so that said raised portion extends radially past the peripheral edge;

indicia located on said raised portion so that said indicia is visible from angles perpendicular and parallel to said peripheral edge; and means to bias said at least one vertically oriented incremental weight disc relative to each of said bars, such that said raised portion is maintained in a generally constant upright position so that said indicia remains visible, whereby the weight disc may be transferred from one bar to the other bar by sliding the weight disc along the length of one bar, sliding the weight disc over the small gap between the proximal ends of the bars such that the weight disc may be supported by both bars simultaneously, and sliding the weight disc along the length of the other bar.

2. A weight transfer device as in claim 1, wherein said means to bias said at least one vertically oriented incremental weight disc relative to each of said bars comprises each bar having a triangular cross-sectional shape and said hole in said at least one vertically oriented incremental weight disc having a mating triangular shape.

3. A weight transfer device as in claim 1, wherein said means to bias said at least one vertically oriented incremental weight disc relative to each of said bars comprises each bar having a rectangular cross-sectional shape and said hole in said at least one vertically oriented incremental weight disc having a mating rectangular shape.

4. A weight transfer device as in claim 1, wherein said means to bias said at least one vertically oriented incremental weight disc relative to each of said bars comprises each bar having a circular cross-sectional shape and said hole in said at least one vertically oriented incremental weight disc having a mating circular shape and located in a position off-set from the center of gravity of the weight disc.

5. A weight transfer device as in claims 1, 2, 3 or 4 wherein said bars comprise a first horizontal bar having its distal end supported by a frame of an exercise machine and a second horizontal bar having its distal end supported by a topmost weight in a stack of weights.

6. A weight transfer device as in claims 1, 2, 3, or 4 wherein said bars comprise a first bar having its distal end supported by a frame of an exercise machine and a second bar having its distal end supported by a topmost weight in a stack of weights, and said first and second bars being tilted upward 3 to 5 degrees from a horizontal orientation.

* * * * *